US005340955A

United States Patent [19]

Calvillo et al.

[11] Patent Number: 5,340,955

[45] Date of Patent: Aug. 23, 1994

[54] ILLUMINATED AND MOISTURE-SEALED SWITCH PANEL ASSEMBLY

[75] Inventors: Samuel J. Calvillo, Orange; Donald L. Horton; Frank Ganz, both of Los Angeles, all of Calif.

[73] Assignee: Digitran Company, a Division of Xcel Corp., Ontario, Calif.

[21] Appl. No.: 916,414

[22] Filed: Jul. 20, 1992

[51] Int. Cl.[5] ..... H01H 13/06

[52] U.S. Cl. ..... 200/302.2

[58] Field of Search ..... 200/302.2, 516, 513

[56] References Cited

U.S. PATENT DOCUMENTS

| | | | |
|---|---|---|---|
| 3,829,632 | 8/1974 | Klehm, Jr. | 200/302.2 |
| 4,018,999 | 4/1977 | Robinson et al. | 200/302.2 |
| 4,203,013 | 5/1980 | Serras-Paulet | 200/302.2 |
| 4,456,800 | 6/1984 | Holland | 200/516 |
| 4,471,189 | 9/1984 | Bacon et al. | 200/302.2 |
| 4,540,865 | 9/1985 | Calder | 200/513 |

FOREIGN PATENT DOCUMENTS

| | | | |
|---|---|---|---|
| 3504424 | 8/1986 | Fed. Rep. of Germany | 200/302.2 |
| 4106820 | 4/1992 | Japan | 200/302.2 |

*Primary Examiner*—Renee S. Luebke

*Attorney, Agent, or Firm*—Louis Bernat

[57] ABSTRACT

An environmentally sealed key switch assembly has a key pad formed from a plurality of individual keys preferably arranged in rows and columns. A first elastomeric sheet has a plurality of holes corresponding to positions of keys in the key pad. Each hole stretches around a corresponding one of the keys in order to provide an environmental seal. A second and unbroken elastomeric sheet stretches under the keys to provide a second environmental seal. The keys press downwardly upon, stretch, and deform the second elastomer sheet and thereby operate an electrical contact. When the key is released the memory of the elastomeric sheets provide a return force to restore the key to normal.

9 Claims, 2 Drawing Sheets

ILLUMINATED AND MOISTURE-SEALED SWITCH PANEL ASSEMBLY

This invention relates to an environmentally protected electrical switch, especially one which may be used outdoors and also in areas exposed to environmentally hostile liquids.

The term "environmentally hostile liquids" is used herein to mean any liquid which may attack or destroy many of the materials that are used in an electrical switch. Examples of such hostile liquids are water, gasoline, motor oils, cutting oils, cleansing fluids, solvents and the like. In addition, the inventive switch may be exposed to blowing sand, dust, and other solid particulates. The weather, blowing snow, ice, driving rain and the like also take their toll on electrical switches of the described type.

There are other considerations which also go into the design of the described type of switches. Specifically, the switches should meet the requirements of The National Electrical Manufacturers' Association (NEMA) ratings: Types 2, 3, 3R, 3S, 4, 4X, 6, 12 and 13. The key used to operate the switch should have a means for providing a tactile feedback to inform the user of a successful switch operation. The switch should resist tampering by members of the general public when it is installed in isolated or unsupervised areas. The switch should be equally usable in hostile outdoor or indoor environments.

Accordingly, an object of the invention is to provide new and improved electrical switches especially—but not exclusively—for use in hostile or unprotected environments. Here an object is to protect such a switch against attack by fluids, wind, rain, snow, ice and the like.

Another object is to provide low-cost and reliable electrical switches which give the user an option key travel, with tactile feedback.

In keeping with an aspect of the invention, these and other objects are accomplished by providing a box-like frame or housing substantially closed on five sides and having a stack of plates or layers on the sixth side. Preferably, this box is also NEMA rated; or, the switch is installed into a NEMA-rated or approved housing enclosed in order to meet NEMA compliance. The appropriate NEMA enclosure may be provided by the manufacturer or customer.

These plates or layers include a plurality of keys laid out in a suitable key pad, keyboard, or the like (hereinafter "key pad"). Preferably, the key pad, keyboard, or the like may have an orthogonal arrangement with rows and columns of keys. A resilient elastomer membrane has a complementary array of holes that stretch around each individual key in order to provide both a continuous panel seal and also a return spring force. By use of a suitable snap-action key dome, the key stroke may have a suitable amount or tactile feedback. Other plates or layers provide various additional forms of seals, switching elements and feedback return.

A preferred embodiment of the switch is shown in the attached drawing wherein.

Figure 1:
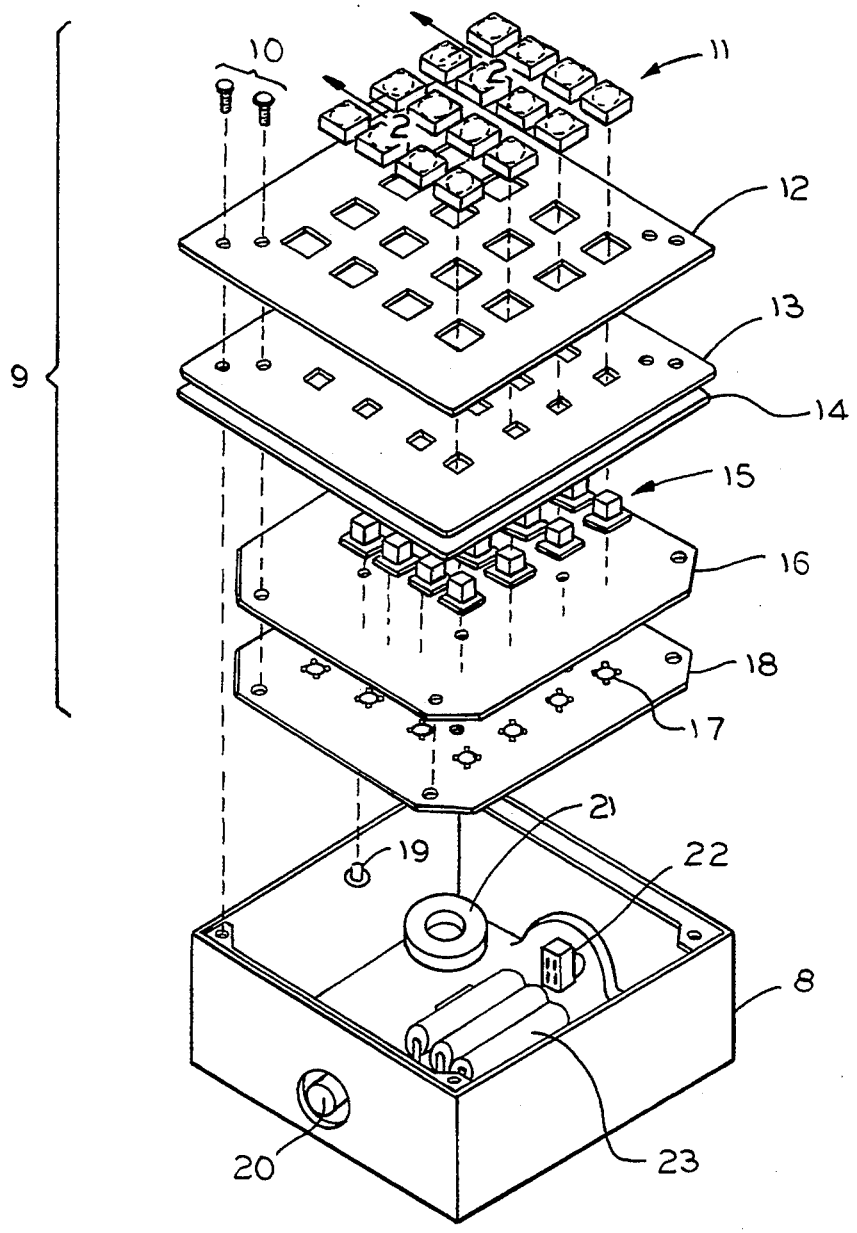
FIG. 1 is an exploded view of the inventive switch.

The inventive switch is shown in exploded view in FIG. 1 as including a box-like housing 8 and stack 9 of plates or layers. The housing 8 is a box which is substantially closed on five sides (bottom, and four vertical sides). The stack of layers 9 close the sixth side (top) of the housing 8 and are held in place by a suitable number of screws 10 or other suitable fasteners.

The uppermost layer comprises a plurality of key caps 11 in the rows and columns of an orthogonal key pad arrangement. Each of the caps 11 fits over an individually associated one of the keys 15, also arranged in an orthogonal key pad arrangement. Preferably, the individual key caps and the keys which they cover are molded from opaque, translucent, clear, or colored plastic, or a combination thereof. Titles, legends, or other symbols may be applied to these key caps by any suitable means such as pad printing, engraving or embossment, double shot molding, film clips, transfer decals, or the like.

Each of the key caps 11 is captured in a complementary array of openings formed in bezel or front panel 12, which is one of the basic supports for all of the switch components. On each of the plates or layers, there are aligned holes for receiving the screws 10 which attach them to the housing 8, frame or panel. Any other suitable indexing and aligning means may also be provided, such as through holes or studs, for engaging complementary parts on neighboring plates or layers.

The next layer 13 is a first elastomer sheet made of a suitable material having an elastic characteristic where a solid key member of each key mechanisms 15 passes through an individually associated hole, stretching the perimeter of the hole in the process. The individual key caps 11 fit over, engage, and are secured to the keys which have passed through complementary holes in the layer 13. The key caps rest on and capture the stretched material 13 surrounding the individual solid key members. The stretching and capturing of the perimeter of these holes makes a seal for protecting against an invasion of fluids, particulates or the like into the interior of housing 8, enclosure or panel. The elastomeric sheet 13 also reacts to vertical key displacement so that it acts as a return spring to raise the combination key cap and key to a normal position after each depression.

The next layer 14 is a rigid support plate which tends to cooperate with bezel 12 to compress and support the first elastomer sheet 13. Layer 14 also helps maintain the environmental seal around the keys and under the key caps and tends to control the return force provided by the memory of the elastomer sheet. Primarily, the degree of control results from the sizes of the key cap and key cross sections relative to the size of the holes in layer 14 surrounding the keys.

At 15, the keys themselves are positioned under the key caps and are orthogonally arranged in rows and columns to form a key pad. Each individual key defines a cross-point. The individual key mechanisms 15 may be made of a plastic material which transmits light so that an illuminated key pad may be provided. Also, each of the keys 15 enjoys a vertical travel which may close (open) and actuate (release) switch contacts, such as dome contact 17.

Layer 16 is a second substantially unbroken elastomer sheet or membrane barrier which may be made of a material such as rubber or polyurethane. The key mechanisms 15 push the second membrane 16 downwardly so that it stretches and deforms under a key stroke pressure. As the membrane deflects, it bears against and closes a contact at a cross-point where the actuated key is located. When the key is released, the elasticity of the second membrane 16 helps provide a restoring force to return the key to a normal position and open the contact at that cross-point.

Layer 18 is preferably a printed circuit board, although similar wiring devices may be used. A plurality of dome switches or contacts 17, are made of a resilient spring-like material (e.g. stainless steel). Each dome is attached to the printed circuit board at a location under and pushed by an individual associated key.

Each dome switch is positioned over an intersection where two printed strip lines or wires (or the equivalent) come together, but do not touch. When an associated key presses the dome switch downwardly, it collapses and short circuits or connects these two strip lines, wires, or the like, thereby closing a circuit. When the key is released, the dome pops up owing to its own resilience in order to remove the short circuit and open the connection between the wires. These switches are sometimes called "oil can" switches because the spring action is somewhat similar to the spring action at the circular bottom of an oil can.

External wires may make connections to the printed circuit board strip lines or conductors in any conventional manner. The manner of sealing these wires as they pass through the housing 8 is entirely conventional.

The housing 8 may contain any of a suitable number of additional components. A lamp 19 may light to transmit light through the key mechanisms 15. While different types of lamps may be used, an incandescent lamp of any suitable voltage and brightness is preferred. Preferably, it has a base which provides a quick connect and disconnect, with no special tools required. One such suitable base is known as a "wedge base" where the lamp is released by a slight turn. A push- button switch 20 on the outside of housing 8 may control the lighting of the lamp 19.

Another item which may be included in the housing 8 is an annunciator 21 which sounds whenever a push button 22 on the outside of the housing is pressed. The reason for having an annunciator is irrelevant to the invention. It may be used to give an audible feedback indicating that a key has been operated. It may also be used to summon an attendant.

A suitable number of batteries 23 may be provided to power the lamp 19 and annunciator 21.

The first and second membranes 13 and 16 are sheets made of any suitable elastomeric material which is able to withstand the attack by environmental contaminants, the weather, and the like. While many different materials may be used, I prefer to use one of those sold under the trademark "Tuftane". A fluorosilicone rubber (Military Specification Mil-R-25988B) may also be used. The Military specification for fluorosilicone elastomer (MIL-R-25988B) is dated Jul. 12, 1983

The manufacturer Tuftane, Inc., Route 128, Exit 12, Causeway Street, Gloucester, MA01930-2186 described "Tuftane" polyurethane film as follows:

| | |
|---|---|
| Hardness | 80–97A |
| Specific Gravity | 1.1 · 1.3 |
| Elongation % | 400–600 |
| Tensile PSI (OOO) | 4 · 10 |
| Low Temp Flex | Excellent |
| Resistance To: | |
| Abrasion | Excellent |
| Tearing | Excellent |
| Oil | Good |
| Ozone | Excellent |
| Water | Good–Excellent |
| Heat Sealable | Yes |
| Heat Bond | Yes |
| Solvent Bond | Yes |
| Ultrasonic Bond | Yes |
| Thermoformable | Yes |

A number of different types and grades of this product are available and may be selected according to particular needs. By way of further identification one of these grades (TF-310) is described as follows:

TYPICAL FILM PROPERTIES

| | ASTM Test Method | TF-310 |
|---|---|---|
| Hardness (Shore A) | D-2240 | 93 |
| Specific Gravity | D-792 | 1.22 |
| Approximate Yield (ft.$^2$/lb./mil) | — | 157 |
| Tensile Strength (psi) | D 882 Method A | 8000 |
| 100% Modulus (psi) | D 882 Method A | 1600 |
| 300% Modulus (psi) | D 882 Method A | 3200 |
| Elongation (%) | D 882 Method A | 500 |
| Tear Strength (pli) Die C | D 624 | 600 |
| Abrasion Resistance (mg wt. loss) Taber w/CS-17 wheels with 100 g load/5000 cycles at 23° C. | D 1044 | 2.3 |

| | |
|---|---|
| Natural Appearance | Clear |
| Slip Characteristics | Medium |
| Weldability | Excellent |
| Vacuum Formability | Good |
| UV Stability | Fair |
| Heat-Activated Adhesive (Porous Substrates) | X |
| AVAILABILITY | |
| Gauge (mils) | 1–60 |
| Width (inches) | ¼–80 |
| Colors | All |

Figure 2:
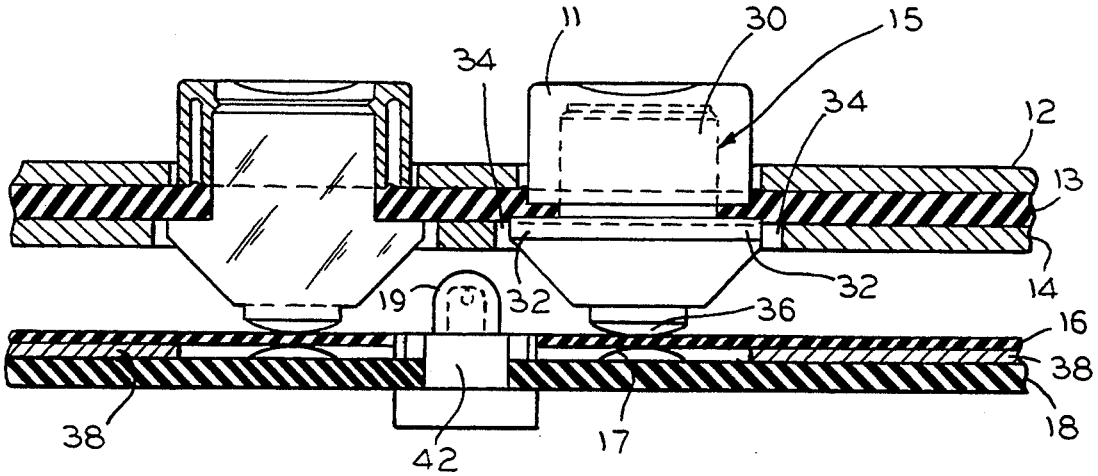
FIG. 2 is a cross section of part of a first embodiment of the assembled switch, taken along part of the line 2—2 of FIG. 1.
Figure 6:
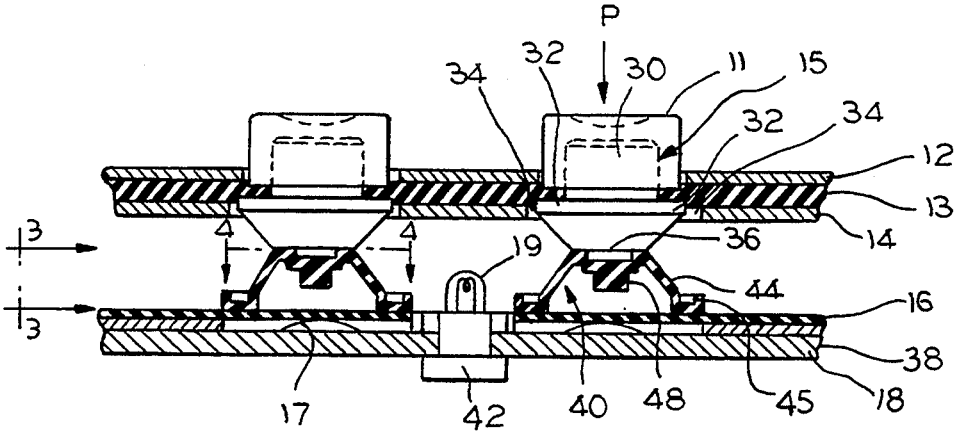
FIG. 6 is a cross section of a part of a second embodiment of the assembled switch that uses the dome of FIGS. 3, 4, also taken along part of the line 2—2 of FIG. 1.

The manner of assembling the inventive switch will become more apparent from a study of FIGS. 2 and 6. The embodiment of FIG. 2 merely operates the dome switches with no particular tactile feed back other than a bottoming of the key at the end of the key stroke. The embodiment of FIG. 6 gives a positive, snap-like tactile feedback which is detected by the finger pushing the switch.

Each key 15 mechanism (FIG. 2) has a solid key member or shaft 30 which fits fairly snugly inside the key cap 11. The lower end of key member or shaft 30 spreads to provide shoulders 32, 32 which fit under, receive and support the stretched perimeter of the holes in the first elastomer membrane or layer 13. The key cap 11 fits down and on top of that stretched perimeter so that it is captured between shoulders 32, 32 and the bottom edge of cap 11. The bezel 12 is preferably metal or a hard plastic which fits over the top of and stabilizes the first elastomer membrane or layer 13. Bezel 12 tends to protect the entire upper surface of sheet 13. Likewise, the hard support plate 14 also fits under and tends to stabilize the first elastomer membrane or sheet 13.

It should be noted that the holes in support plate 14 are large enough at 34, 34 so that the elastomer sheet 13 may stretch and enable the key cap 11 and key 15 to move downwardly during a key stroke. Responsive to such movement, the bottom 36 of the key mechanism 15 deflects a dome switch 17 to interconnect printed circuit strips or wires 38 laid out in an orthogonal pattern. These strips or wires meet but do not touch each other at a cross-point where a dome switch 17 is located. When pushed, the dome switch deflects enough to interconnect the strips or wires 38. When released, the dome switch returns to its original shape to open the cross-point by disconnecting these strips or wires 38 from each other.

The lamp base 42 may be easily withdrawn from the printed circuit board 18 in order to replace the lamp 19. Preferably, the lamp base 42 locks to board 18 or releases responsive to a quarter-turn.

FIGS. 3–6 show a second embodiment which provides a tactile feedback when a key is pushed.

Figure 3:
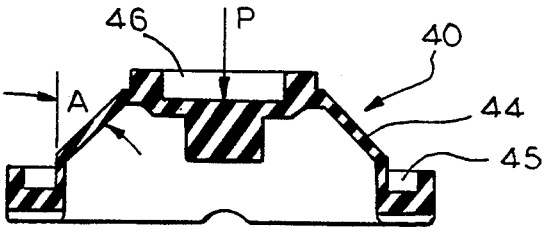
FIG. 3 is a cross section of an optional snap-action dome for covering a key in a second embodiment of the switch, the cross section of FIG. 3 being taken along line 3—3 of FIG. 6.
Figure 4:
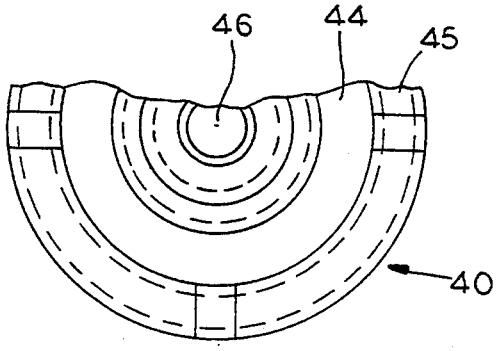
FIG. 4 is a top plan view of the dome of FIG. 3, the plan view being taken along line 4—4 of FIG. 6.

The snap-action dome 40 of FIGS. 3, 4 is an injection molded part made of a flexible thermoplastic having a memory which causes it to return to its normal shape after it has been deformed and collapses. The snap-action dome 40 is a somewhat conical frustrum plastic spring which has a wall thickness and truss construction that enables it to collapse when pushed and to return to its original shape when released.

The preferred snap-action dome material is sold under the trademark "Riteflex" No. 635. The somewhat conical skirt 44 preferably has a thickness of about 0.008-inches, with a surface finish of "16 microfinish" or better. The inclination of the somewhat conical frustrum skirt 44 has an angle A, which is preferably about 45°. The outer edge 45 of the skirt 44 has a beam-like construction which makes it rigid so that a collapse of the snap-action dome 40 necessarily occurs in the skirt region 44 without dislodging dome 40. The top of the snap-action dome 40 has a pocket 46 for receiving the bottom 36 of a key 15. Dependent below pocket 46 is an activator 48 which engages and pushes downwardly upon a switch contact 17, and effects a switch contact closure which may involve a use of a membrane switch as shown in FIG. 7.

As shown in FIG. 6, the bottom 36 of key mechanism 15 fits into a pocket 46 at the top of the snap-action dome 40. The bottom of snap-action dome 40 is supported by printed circuit card 18. When a force P presses downwardly on top of the snap-action dome 40, it collapses with a suddenness which can be felt by the finger applying the force. When the key pressure is released, the plastic memory of the snap-action dome 40 causes it to return to its original shape.

Figure 5:
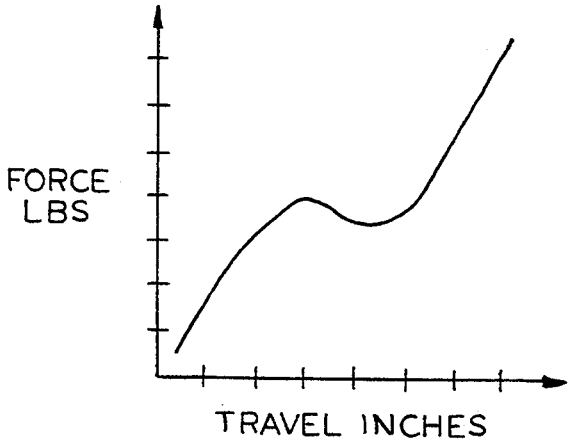
FIG. 5 is a graph showing the force/travel characteristic of the dome of FIGS. 3, 4.

FIG. 5 is a graph which shows the force/travel characteristic of the snap-action dome of FIGS. 3, 4. The finger pressing a key mechanism 15 feels the break when the curve reverses its direction as the snap-action dome 40 collapses under downward pressure P.

Figure 7:
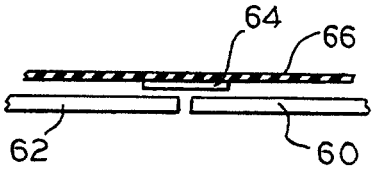
FIG. 7 shows a membrane switch.

A membrane switch is shown in FIG. 7 as being exemplary of any of a number of switches which may be substituted or used in place of the dome switch 17. FIG. 7 shows two strip lines 60, 62 on a printed circuit board. A patch of gold 64 is supported on a mylar sheet 66. The mylar sheet 66 is positioned under elastomeric sheet 16 (FIG. 1). When a key is depressed, the patch of gold 64 is pressed down to electrically interconnect the strip lines 60, 62. In some cases, conductive rubber, or the like, may replace the gold patch 64.

Those who are skilled in the art will readily perceive many modifications which may be made to the described structure. Therefore, the appended claims are to be construed to cover all equivalent structures falling within the scope and the spirit of the invention.

The claimed invention is:

1. A sealed key switch assembly comprising a printed circuit board having an array of conductive strips thereon which are paired to meet but not touch at cross-points, a key pad comprising a plurality of individual key mechanism, each of said key mechanisms including at least a key which may be pushed by the user of the key pad, each of said individual key mechanisms being located at an individually associated one of said cross-points, a dome switch individually associated with each of said key mechanisms for operating responsive to a downward pressure or release of said pressure by said associated key mechanisms acting on said dome for interconnecting or isolating the conductive strips that meet at the cross-point where the key mechanism is operated or released, and a first sealing resilient elastomeric sheet having an array of holes formed therein to enable at least said key of each key mechanism in said key pad to pass through and stretch the perimeter of an individually associated one of said holes, the perimeter of each of said holes stretching and surrounding an individually associated key of said key mechanism to for a perimeter seal whereat, the resilience of said sealing elastomeric sheet also providing at least a part of a mechanical spring-like return force for restoring the individually associated key mechanism after it is pushed and a substantially unbroken second sheet of resilient elastomeric material interposed between bottoms of said plurality of key mechanisms in said key pads and said dome switches whereby each depressed key mechanism acts through the resilience of said second sheet as it presses against its individually associated dome switch, the memory of said second resilient sheet providing at least some spring-like return force for restoring the depressed key mechanism to a normal position.

2. The assembly of claim 1 wherein said conductive strips are strip lines on said printed circuit board, and said key mechanism are individually associated with a plurality of said dome switches, each of said dome switches being individually associated with and respectively operated by one of said key mechanisms when it is pushed for electrically joining a pair of said strip lines which meet at a cross-point where the respective dome switch is located.

3. The assembly of claim 1 wherein said key mechanism includes a key cap which fits over a top of an associated key in a weather-proof manner, a lower edge of said key cap capturing said stretched perimeter of said hole surrounding said associated key, said sealing elastomeric sheet having enough freedom of movement to deform when a key mechanism is pushed and to furnish a return force when said pushed key mechanism is released.

4. The assembly of any one of the claims 1, 2 or 3 and means for selectively illuminating at least one of said key mechanisms.

5. An environment proof key switch assembly comprising a housing which is substantially closed on five sides to protect its interior against environmental hazards, a stack of layers closing a sixth side of said housing, said stack of layers comprising a plurality of keys arranged as a key pad, a support plate for supporting said keys, a first elastomeric sheet stretched over said support plate and having a plurality of holes in an arrangement conforming to the arrangement of aid key pad, each of said holes stretching around an individually associated one of said keys and environmentally sealing an outer surface of said entire key pad, a second elastomeric sheet having a substantially unbroken surface stretched under said key pad, a printed circuit board under said second elastomeric sheet, a plurality of strip lines formed on said printed circuit board to provide a plurality of cross-points, each of said cross-points being individually associated with a key in said key pad, and a switch at each of said cross-points and operated responsive to an actuation of an individually associated one of said keys, said switch being located under said substantially unbroken surface of said second sheet, whereby said key deforms said second elastomeric sheet in order to operate its associated switch through said second elastomeric sheet, an elastomeric memory of said deformed second sheet providing some return force to help restore said key when it is released.

6. The assembly of any one of the claims 1, 2, 3 or 5 and annunciator means associated with said assembly for selectively sounding on demand.

7. The assembly of claim 5 wherein each of said switches is a dome switch.

8. The assembly of any one of the claims 1, 2, 3, 5 and 7 and tactile feedback means individually associated with at least some of said keys for giving an indication of an operation of the associated key whereby a finger operating a key can feel when the key is operated.

9. The assembly of claim 8 wherein said tactile means comprises at least one conical frustrum over individually associated ones of said switches and under the key associated therewith, the cone having a wall thickness which collapses with a snap-action when a key mechanism is pushed and returns to its normal state when the key mechanism is released.

* * * * *

UNITED STATES PATENT AND TRADEMARK OFFICE

CERTIFICATE OF CORRECTION

PATENT NO. : 5,340,955

DATED : August 23, 1994

INVENTOR(S) : Cavillo et al.

It is certified that error appears in the above-identified patent and that said Letters Patent is hereby corrected as shown below:

Claim 1, Col. 6, line 37, "for" should read --form--.

line 38, "whereat" should read --thereat--.

Claim 2, Col. 6, line 53, "mechanism" should read --mechanisms--.

Signed and Sealed this

Thirteenth Day of December, 1994

*Attest:*

Bruce Lehman

BRUCE LEHMAN

*Attesting Officer*

*Commissioner of Patents and Trademarks*